US006450511B1

(12) United States Patent
LaVoy

(10) Patent No.: US 6,450,511 B1
(45) Date of Patent: Sep. 17, 2002

(54) SNOWBOARD BINDING MOUNT ASSEMBLY

(76) Inventor: Thomas F. LaVoy, 6307 S. Poplar Ct., Englewood, CO (US) 80111

( * ) Notice: Subject to any disclaimer, the term of this patent is extended or adjusted under 35 U.S.C. 154(b) by 0 days.

(21) Appl. No.: 09/514,847

(22) Filed: Feb. 28, 2000

(51) Int. Cl.[7] ..... B62B 9/04

(52) U.S. Cl. ..... 280/14.22; 280/14.24; 280/618

(58) Field of Search ..... 280/14.24, 618, 280/14.22, 617, 607, 633; 296/60

(56) References Cited

U.S. PATENT DOCUMENTS

| | | | | | |
|---|---|---|---|---|---|
| 5,261,689 | A | * | 11/1993 | Carpenter et al. | 280/618 |
| 5,354,088 | A | * | 10/1994 | Vetter et al. | 280/618 |
| 5,499,837 | A | * | 3/1996 | Hale et al. | 280/607 |
| 5,520,405 | A | * | 5/1996 | Bourke | 280/613 |
| 5,553,883 | A | * | 9/1996 | Erb | 280/607 |
| 5,667,237 | A | * | 9/1997 | Lauer | 280/607 |
| 5,732,959 | A | * | 3/1998 | Soejima | 280/14.24 |
| 5,782,476 | A | * | 7/1998 | Fardie | 280/14.24 |
| 5,803,481 | A | * | 9/1998 | Eaton et al. | 280/633 |
| 5,897,128 | A | * | 4/1999 | McKenzie et al. | 280/607 |
| 5,947,488 | A | * | 9/1999 | Gorza et al. | 280/14.21 |
| 6,062,584 | A | * | 5/2000 | Sabol | 280/607 |

FOREIGN PATENT DOCUMENTS

| | | | | |
|---|---|---|---|---|
| FR | 2643277 | * | 8/1990 | A63C/9/18 |
| FR | 2652753 | * | 4/1991 | A63C/9/00 |

* cited by examiner

*Primary Examiner*—Lanna Mai
*Assistant Examiner*—Christopher Buchanan

(57) ABSTRACT

A swivelable mount for the boot bindings of a snowboard or wakeboard or the like, including a low profile top plate with a downwardly extending circular outer wall which screws down onto matching threads on the outer edge of a circular bottom plate which attaches to a snowboard. The top plate provides an inner-facing threaded flange positioned opposite the outward-facing threaded surface of the bottom plate, and prevents upward movement of the top plate from the snowboard, thereby keeping the snowboard rider firmly attached to the snowboard. The two plate surfaces are slideable on each other when a spring pin, mounted to the top plate and extending through a hole in the bottom plate, is drawn upwardly, corresponding to an unlocked, rotatable condition of the top plate allowing the upper surface to rotate to another position as determined by the placement of the holes. When the spring-loaded pin is released, the pin engages the opposing bottom plate hole and prevents the top plate from rotating.

7 Claims, 5 Drawing Sheets

SNOWBOARD BINDING MOUNT ASSEMBLY

BACKGROUND OF THE INVENTION

1. Field of the Invention

The present invention relates to binding mount systems for snowboards and wakeboards, and more specifically to a simply constructed binding mount that allows binding attachment and swiveling of both the front and rear bindings, without the removal of the feet from the bindings, for rapid angular adjustment relative to the centerline of the snowboard or wakeboard.

2. Description of the Prior Art

In recent years, the popularity of snowboarding and wakeboarding have grown at a tremendous rate. If continued, snowboarding will surpass the popularity of downhill skiing. To draw more current skiers or neophytes of skiing and snowboarding into the sport of snowboarding, more convenient and comfortable binding systems are required. Binding systems, to date, have meant awkward, if not painful, experiences by snowboarders, especially beginning snowboarders. A typical snowboard is essentially a single, wide ski that has fore and aft boot bindings that support both feet at a substantial angle with respect to the centerline of the snowboard. This foot angle needs to be changed by some snowboard riders depending on the activity they are about to perform and the changing snow conditions. The cross-orientation of the bindings allows the rider to assume a side-forward stance, which is the necessary anatomical positioning for optimal in-use control of the snowboard. While this side-forward positioning is optimal for in-use control on the downhill run, it can result in problems for the snowboarder during non-snowboarding periods of use, such as when the snowboarder is maneuvering on flat terrain after having come to a complete stop, the chairlift boarding area, which is generally flat or at a very slight incline, the chairlift boarding and unloading areas, and while riding on the chair lift. Thus, it is a common and necessary practice for the snowboarder in such circumstances to disengage one boot, usually the aft boot, from its binding which allows the user to ride in what is termed "skate-board" style by propelling himself with his free foot. Problems result because the "skate-boarding" snowboarder who tries to assume a body forward position during this time is compelled to hold his body in an unnatural and twisted position relative to the foot that is attached to the snowboard, which, besides being uncomfortable, exerts stress and strain on the body. Because a comfortable body-forward position is prevented, the ability for a beginning snowboarder to propel himself forward is greatly hindered. In addition, the problem of undue stress and strain on the snowboarder's leg and knee can be experienced by the snowboarder during his ride in the chairlift when he attempts to hold the attached snowboard, with one foot attached, in a manner that does not interfere with his chairlift companions.

One apparent solution to the problem is to provide means that will allow at least one of the bindings to be rotated from the normal transverse angular position to a toeforward position relative to the snowboard, during non-snowboarding use of the snowboard by the user. In this regard, it is noted that prior art does show some examples of snowboard bindings with respect to the snowboard centerline. In U.S. Pat. No. 5,236,216, for example, there is shown a fastening disk that can be clamped upon a binding support plate that can be turned about a normal axis to the board. In order to change the user's foot position, the user must remove his boot from the binding, allowing him to loosen several bolts to allow the rotational position of the binding plate to be changed, then the bolts must be re-tightened. Similarly, in U.S. Pat. No. 5,261,689, a number of bolts through a hold-down plate for a rotatable binding-support plate must be loosened and then re-tightened in order to change the binding orientation. While the aforementioned binding support systems have their advantages, they all share a major drawback in not allowing angular adjustment of bindings to be made quickly, easily, and conveniently, because they require removal of the boot from the binding in each case, and the use of the tools to tighten and loosen the bolts.

U.S. Pat. Nos. 5,499,837, 5,667,237 and 5,732,959 recognize some of these unique problems to snowboard bindings; however, these binding mounts do not provide for the problem of snow and ice build-up inhibiting the proper operation of the locking mechanism. U.S. Pat. Nos. 5,782,476 and 5,9474,488 have such a large number of parts that it would adversely affect their commercial marketability. U.S. Pat. No. 5,553,883 also allows the binding's angular rotation to be adjusted without the removal of the snowboarder's foot from the binding, but requires a large number of holes to be placed into the snowboard causing potential structural weakness and a different "feel" to the snowboard than what the snowboard manufacturer intended. This design also allows snow and ice to be deposited into the exposed holes in the snowboard making it impossible for the spring loaded plunger to firmly seat itself in these holes blocked by snow and ice.

SUMMARY OF THE INVENTION

It is a general object of the present invention to provide for a snowboarder or wakeboarder, the capability of rapidly and easily changing the orientation of at least one of his bindings-attached feet from a transverse position on such a transport board to a toeforward position, thereby enabling a natural position of the knee, foot, and leg during standing, walking, sitting, and "skate boarding".

Another object is to provide for a snowboarder, the capability of easily, quickly, and effectively, without disengaging one's feet from the snowboard, making adjustments to the angular orientation of the binding with respect to the centerline of the snowboard.

A related object is to provide snowboard users with substantially increased comfort and convenience during lift line and lift ride durations.

A still further object is to provide a way to substantially reduce the risk of harmful stress to the leg joints, ligaments and muscles of snowboarders.

Yet a more particular object is to provide ergonomically advanced locking system for a swivelable binding, featuring a spring loaded pin mechanism that is easy to manipulate for locking and unlocking.

Another object is to provide a snowboard binding mount assembly that can freely rotate in severe weather conditions as are often found on mountains in the winter.

Yet another object is to provide for the wakeboarding enthusiast a toe-forward bindings position during launching, which orientation can be quickly and easily changed to a cross-board orientation during subsequent wakeboarding.

These, and other objects and advantages are provided by the present invention of a rotatable mount and locking mechanism for the binding of a snowboard, wakeboard, or the like, including a rotatable upper plate adapted for attaching and supporting said binding, and threaded side walls, and enclosing a bottom plate, concentric with said upper plate; a bottom plate member for supporting said top plate, and adapted to be affixed to said snowboard; a locking means, mounted to said top plate, for rotating said rotatable plate substantially from its first position to an alternate position by lifting spring pin out of one hole and allowing the spring to force the pin into another hole; and a stopping block with dowels and stopping block screw device for preventing the further rotational movement of the top plate relative to the bottom plate.

Some snowboard users prefer to start the day with one orientation of their feet and change the desired orientation according to changing snow, weather and muscular conditions, and accordingly it is a further object of the invention to provide a board user with the capability of making rapid rotational adjustment of the binding of a given board, as required to suit the desired preferences.

DETAILED DESCRIPTION OF THE INVENTION

Figure 1:
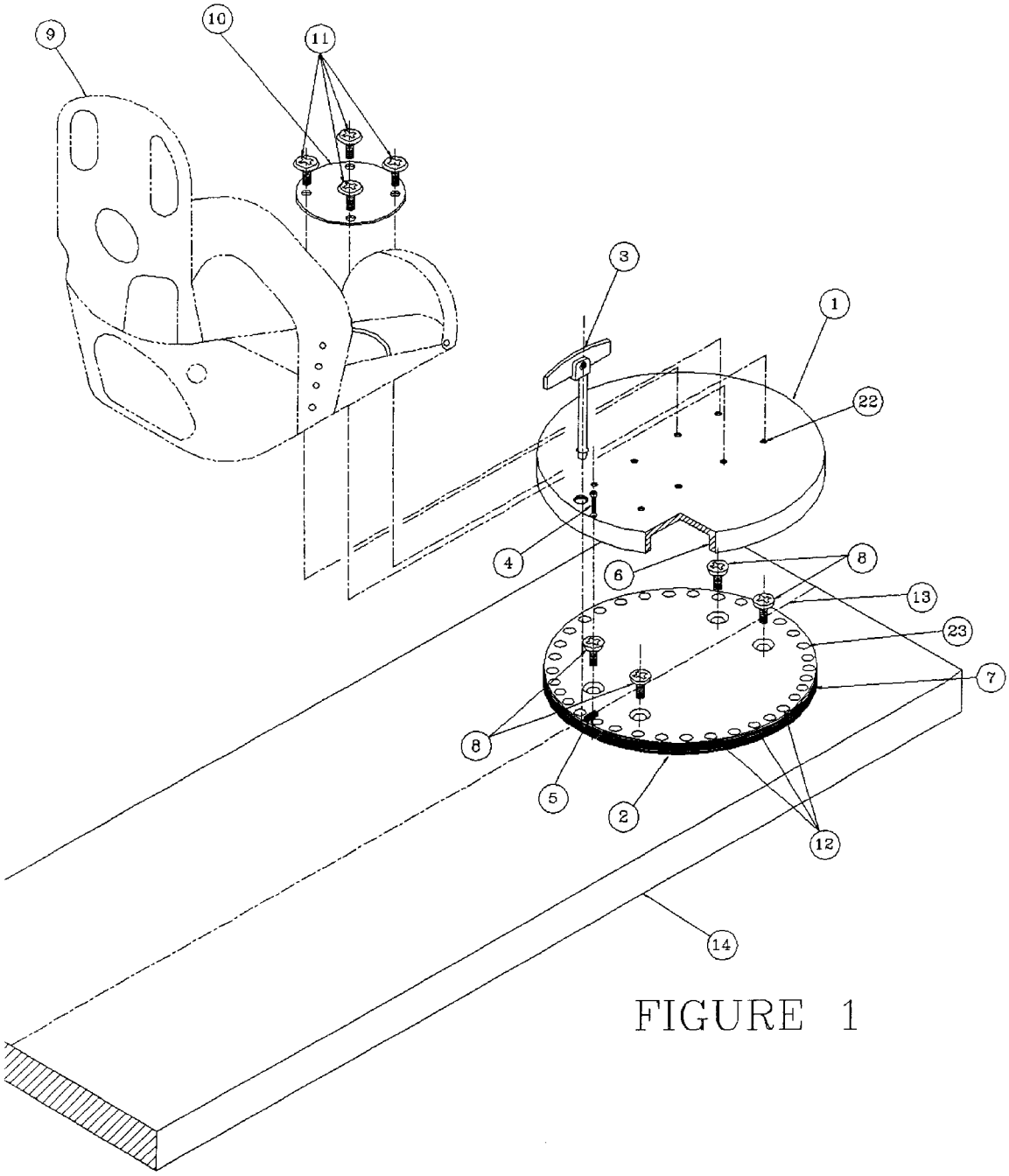
FIG. 1 is a top partially perspective view of a binding mount and lock mechanism for rotatably and continuously attaching a snowboarder's binding, and therefore his boot and foot, to a snowboard showing a preferred embodiment according to the present invention. The snowboard binding and round attachment plate are shown for illustration only.
Figure 1A:
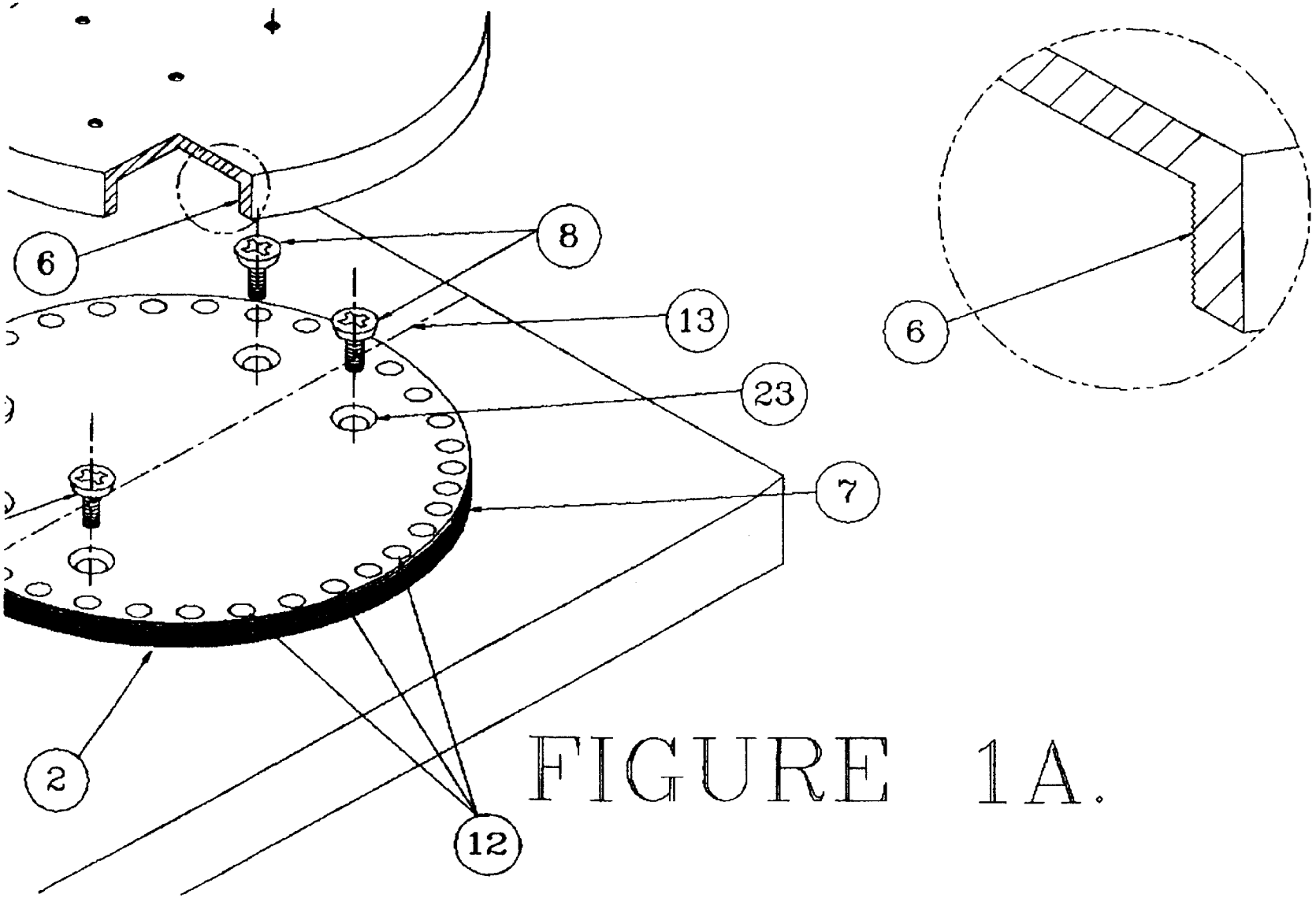
FIG. 1A is a closer look at the top and bottom plates illustrating how the two plates use threads to screw together and showing how the bottom plate is attached to the snowboard.

Referring to the drawings, FIG. 1, and the close-up in FIG. 1A, shows a binding mount 1 and related spring pin lock mechanism 3 for allowing a boot binding 9 to swivel about a longitudinal centerline 13, normal to a snowboard 14, and for releasably locking it at multiple desirable angles with respect to the centerline 13 of the snowboard 14. The binding mount for the fore and the aft foot locations are identical, therefore only one binding mount will be described. The binding mount top plate 1 has a flat top surface and serves as the attachment receiving means for the binding 9. The arrangement of the screw receptacles 22, in the top of this plate, allows the binding 9 to fasten directly to the plate 1. The top plate has screw threads 6 positioned inside the outer circular wall which complement, and form the connection to, the bottom plate screw threads 7 and limit upward or downward movement of the top plate. Top plate 1 includes a spring loaded mechanism 3 which can be pulled out of one of many fastener receiving holes 12 in bottom plate 2 to allow for rotatably repositioning of the binding relative to the centerline 13. Top plate 1 also includes a stop block screw 4 which, when in contact with the stopping block 5, prevents the top plate 1 from being completely unscrewed, and therefore detached, from the bottom plate 2 once it is put in place. The bottom plate 2 attaches to the snowboard 14 through the use of four screws 8 which enter through the plate 2 into countersunk holes 23 and fasten into the screw receiving means of the snowboard. On the top side of the bottom plate 2, which is a flat surface, spring pin receiving holes 12 are spaced evenly near the outer perimeter of the plate 2. These holes 12 receive the spring loaded pin 3 after the user has repositioned the binding to a new desired angle relative to the centerline 13. A stopping block 5 is held in place by two dowels 21 driven into the bottom plate 2. This block 5 prevents additional rotation of the top plate 1 relative to the bottom plate 2 when in contact with the stopping block screw 4. While it is desirable to allow the binding to rotate throughout most of 360 degrees, it is undesirable for the top plate 1 to inadvertently separate from the bottom plate 2 during repositioning of the binding. Therefore this stopping block 5 and stopping block screw 4 combination has been put in place. The outside circular edge threads 7 of the bottom plate 2 is designed to complement the inner edge threads 6 of the upper plate 1 forcibly holding the plate I and binding attached to it to the snowboard 14. This design in which the top plate 1 completely covers the bottom plate 2 and the bottom plate's holes 12, allows the binding mount mechanism to rotate freely even under severe cold and snow conditions.

Figure 2:
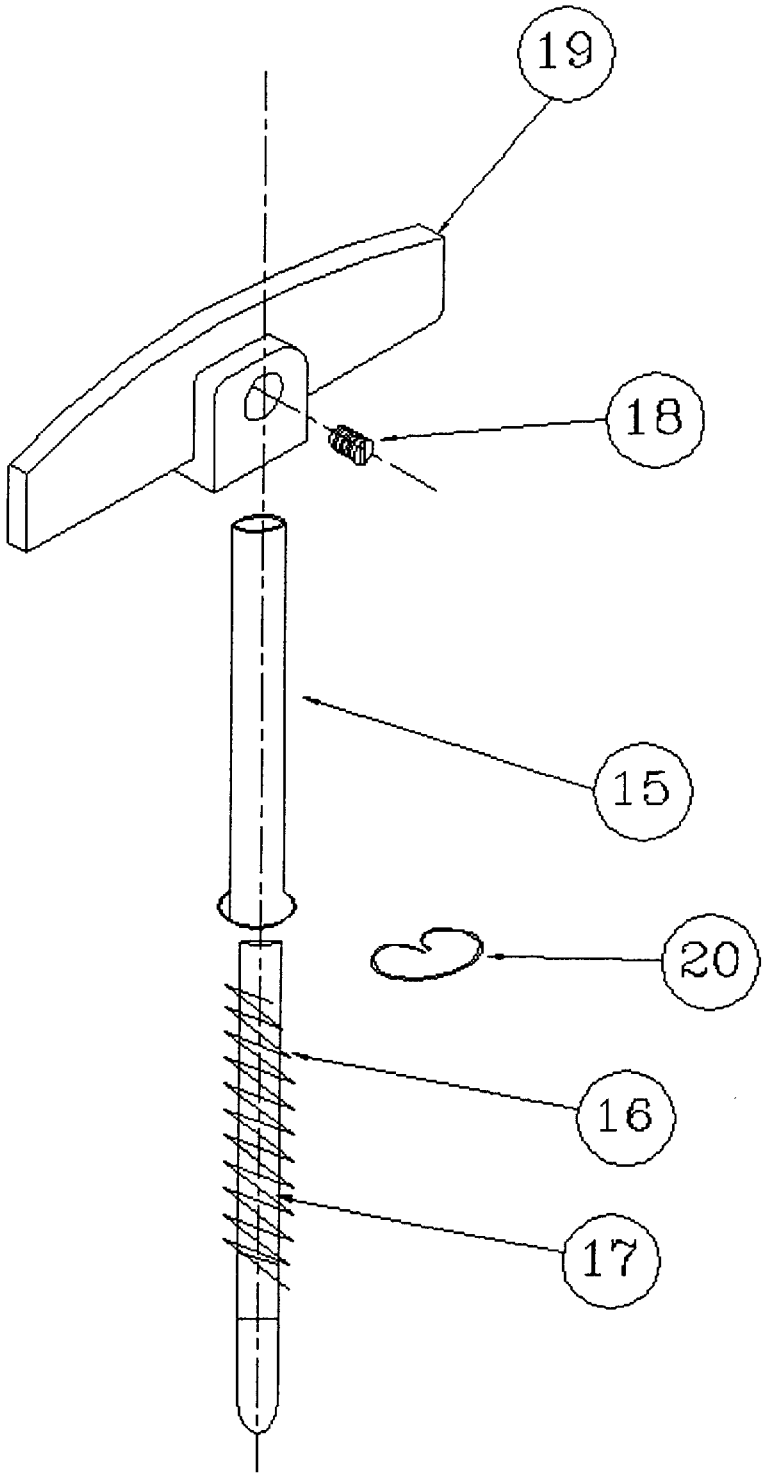
FIG. 2 is a side partially perspective view of the spring pin that mounts into the top plate and protrudes into a hole in the bottom plate to secure the foot from rotatably moving.

FIG. 2 illustrates the components of the spring loaded pin device, including a metal pin 17 and an outer body 15 which encloses a spring 16 which forces the metal pin 17 into a fastener receiving hole. This spring pin 17 is held in place to the T-handle 19 by a setscrew 18. The outer body 15 is attached to the binding mount top plate and held in place by a lock ring 20. The outer body 15 remains motionless while the T-handle 19 moves up and down with the pin 17 attached, thereby forcing the pin 17 into or out of the receiving holes in the bottom plate. With the user's boot continuously attached to the binding, the T-handle 19 moves the spring pin 17 out of its respective receiving hole, allowing rotation of the mount through a desired angle, and then replacing the pin in a different hole when the desired angle is achieved.

Figure 3:
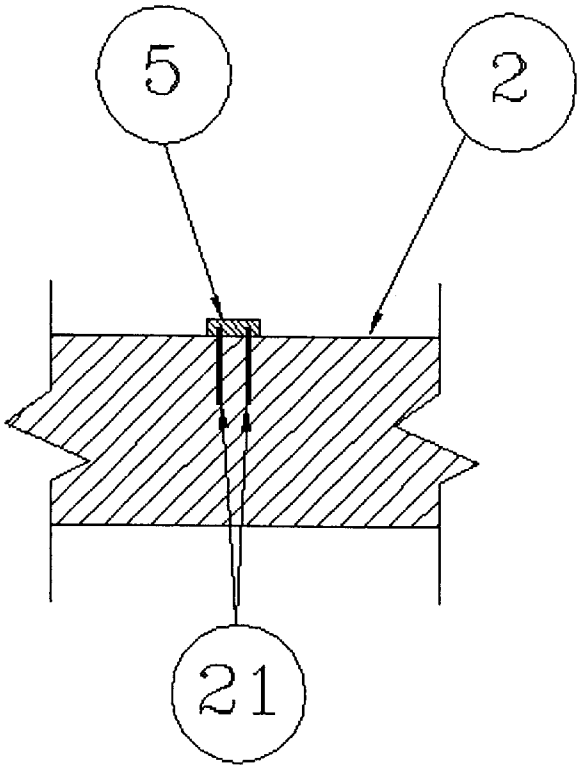
FIG. 3 is a cutaway view showing the stopping block and the two dowels, which extend into the bottom plate, holding the stopping block in place.

FIG. 3 shows a cutaway cross-section of the stopping block 5 connected to the bottom plate 2 through the use of two dowels 21. The dowels 21 extend from inside the stopping block 5 into the bottom plate 2 thereby holding the stopping block 5 firmly in place against the bottom plate 2.

Figure 4:
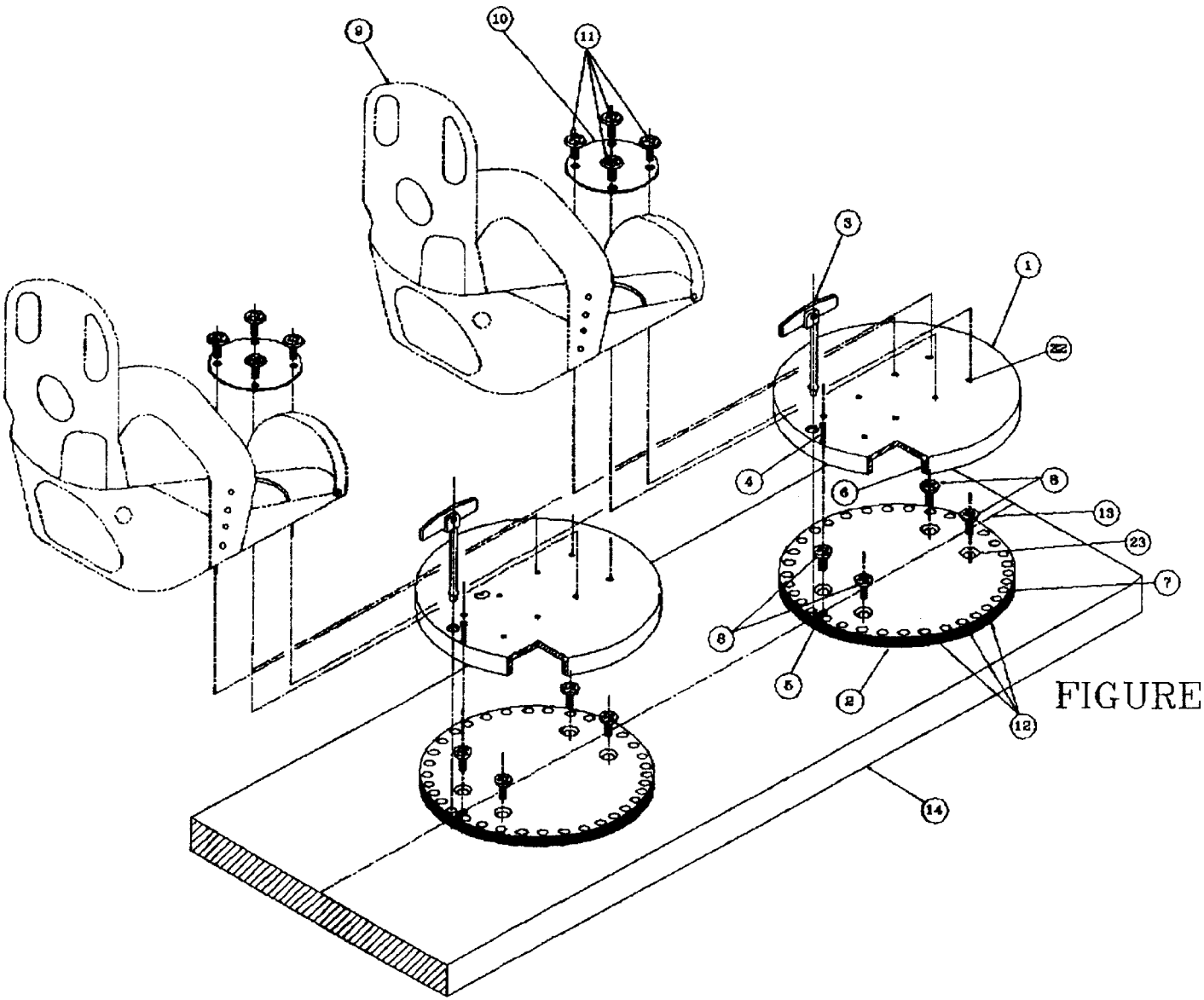
FIG. 4 is a top partially perspective view of both the fore and aft binding mounts and their relative positions on the snowboard.

FIG. 4 shows both the fore and aft binding mounts on a partially represented snowboard. The intended use of the invention is to allow either foot to rotate according to the user's preferences.

While there has been described a particular embodiment of the invention, it will be obvious to those skilled in the art that various changes and modifications may be made therein without departing from the invention. Therefore, it is aimed to cover all such changes and modifications as fall within the true scope and breadth of the invention as defined in the claims that follow.

What is claimed is:

1. A boot binding mount assembly for snowboards and wakeboards comprising:

a circular base plate for fixed securement to the top of a board;

a boot binding;

a top plate for fixed securement of said boot binding thereto, said top plate having a downwardly extending circular flange mated in overlapping snug-fit surrounding relation with the circumferential edge of said base plate, said circular flange having circumferentially extending threads on its inner periphery, said circular base plate having circumferentially extending threads on its circumferential edge for mated association with the threads of said flange, whereby said top plate and said boot binding thereon are rotatably mounted on said base plate for angular positioning of said boot binding on said board; and a retractable locking pin mounted on said top plate, said locking pin being extendable downward for engagement with said base plate to establish a locked angular relation between said top plate and base plate, whereby said top plate is selectively locked at a desired angle on said board and wherein said base plate has distributed position apertures for engagement by said locking pin to permit establishment of the locked relation between said top plate and base plate.

2. A mount assembly for boot bindings as set forth in claim 1, in which said retractable locking pin is spring biased in a downward direction for locking engagement of said pin with a selected aperture in said base plate.

3. A mount assembly for boot bindings as set forth in claim 2 including a spring surrounding said locking pin arranged to draw said pin downward.

4. A mount assembly for boot bindings as set forth in claim 3, including a stationary sleeve vertically mounted on said top plate through which said locking pin and spring extend.

5. A mount assembly for boot bindings as set forth in claim 4 including a blocking member on said bottom plate arranged for engagement by said locking pin to limit rotation of said top plate on said base plate during selective angular positioning of said top plate and binding thereon.

6. A boot binding mount assembly for mounting a boot binding on snowboards and wakeboards comprising:

a circular base plate fixedly secured to the top of a board;

a top plate having said boot binding secured thereto, said top plate having a downwardly extending circular flange mated in overlapping surrounding relation with the circumferential edge of said base plate, said circular flange including a securing means for establishing a rotational secured relation between said top plate and base plate whereby said top plate and said boot binding thereon are rotationally positionable on said board, wherein said securing means comprises threads on an inner periphery of said flange and mating threads on the circumferential edge of said base plate; and a retractable locking pin mounted on said top plate, said locking pin being extendable downward for engagement with said base plate to establish a locked angular relation between said top plate and base plate, whereby said top plate is selectively locked at a desired angle on said board and wherein said base plate has distributed position apertures for engagement by said locking pin to permit establishment of the locked relation between said top plate and base plate.

7. A mount assembly as set forth in claim 6, including a blocking member on said base plate to set a limit of the rotation of said lop plate and binding thereon.

* * * * *